US005564489A

United States Patent [19]

Kehse et al.

[11] Patent Number: 5,564,489

[45] Date of Patent: Oct. 15, 1996

[54] CASTING DEVICE FOR THE CONTINUOUS MANUFACTURE OF METAL STRIP

[75] Inventors: Georg Kehse, Laupheim; Hilmar R. Mueller, Bellenberg; Hubert Magg, Voehringen, all of Germany

[73] Assignee: Wieland-Werke AG, Germany

[21] Appl. No.: 597,575

[22] Filed: Feb. 2, 1996

Related U.S. Application Data

[63] Continuation of Ser. No. 201,742, Feb. 25, 1994, abandoned.

[30] Foreign Application Priority Data

Mar. 5, 1993 [DE] Germany ..... 43 06 863.4

[51] Int. Cl.[6] ..... B22D 11/06

[52] U.S. Cl. ..... 164/429; 164/479

[58] Field of Search ..... 164/479, 429, 164/423, 463

[56] References Cited

U.S. PATENT DOCUMENTS 5,293,926 3/1994 Love et al. ..... 164/479

FOREIGN PATENT DOCUMENTS 0174765 3/1986 European Pat. Off. .
1783135 1/1972 Germany .
3180302 10/1989 Germany .
4135280 5/1992 Germany .
4132189 2/1993 Germany .
61-249648 11/1986 Japan .
1-237051 9/1989 Japan ..... 164/479
3-174951 7/1991 Japan ..... 164/479
622725 4/1981 Switzerland ..... 164/429

*Primary Examiner*—Kuang Y. Lin
*Attorney, Agent, or Firm*—Flynn, Thiel, Boutell & Tanis, P.C.

[57] ABSTRACT

A casting device for the continuous manufacture of a thin metal strip (2) which includes a rotating, cooled conveyor belt guided by guide rollers (3, 4), and a melt distributor (5) juxtaposed the conveyor belt (2) and from which metal melt (7) is fed onto the conveyor belt (2) and is solidified. In order to do away with underpressure in the casting device, the melt distributor (5) includes a distributor base having a surface which extends essentially tangential of a surface of the belt on the guide roller and at a centerpoint angle in front of the apex point (12:00 o'clock position) of the front guide roller (3), viewed in direction of movement of the conveyor belt (2)), that is in the range of 5° to 20°. The front quids roller (3) is cooled at least in the area thereof defined by the respective center-point angle α.

9 Claims, 4 Drawing Sheets

CASTING DEVICE FOR THE CONTINUOUS MANUFACTURE OF METAL STRIP

This application is a continuation of U.S. Ser. No. 08/201,742, filed Feb. 25, 1994, now abandoned.

FIELD OF THE INVENTION

The invention relates to a casting device for the continuous manufacture of a thin metal strip.

BACKGROUND OF THE INVENTION

It is necessary in casting devices of the mentioned type to move the melt without turbulence onto a conveyor belt. With strip thicknesses of between 5 and 10 mm and casting performances of up to 20 t/h, only metallostatic levels of a few millimeters, for example, are needed for the necessary supply pressure. In order to achieve this, DE-PS 3 810 302, for example, describes a vacuum system. DE-PS 4 132 189 uses a pipette principle.

The basic purpose of the invention is to provide a casting device of the mentioned type such that underpressure is not at all needed.

The purpose is attained according to the invention in such a manner that the melt distributor includes a distributor base which terminates in a surface that extends essentially tangential to a surface of the conveyor belt supported on guide rollers and at a center-point angle $\alpha$ in front of the apex point (12:00 o'clock position) of the front guide roller (viewed in moving direction of the conveyor belt) that is in the range of 5° to 20°. The front guide roller is cooled at least in the area thereof defined by the respective center-point angle $\alpha$. The center-point angle $\alpha$ is thereby calculated counterclockwise starting at the 12:00 o'clock position.

Thus the distributor in the casting device of the invention is joined closely with its base to the radius of the guide roller such that there practically does not exist any difference in height between the distributor base and the conveyor-belt plane.

It is known in casting devices for carrying out the so-called melt-drag method that molten metal (compare, for example, EP-OS 0 174 765) is cast onto a mold disc approximately in the 9:00 o'clock position; compared with this melt feeding at 9:00 o'clock, the feeding principle of the invention disclosed therein has the advantage that only a very thin, first shell solidifies in arched form (to the radius of the guide roller). Because of the short arch path, the small dimension and the high temperature, this region of the melt is again straightened during the further transport by the guide roller. Thus no or only such minute microcracks, which can be removed during the subsequent milling, are created. Furthermore, since in the casting device of the invention disclosed therein the melt level can be freely adjusted, the disadvantage of the casting device used for the so-called melt-drag method is avoided, namely, a condition where an uneven cooling over the strip width would cause the strip thickness to vary accordingly.

According to a preferred embodiment of the invention, the range for the center-point angle $\alpha$ is 5° to 10°.

In order to guarantee a constant melt supply during the start-up phase, the distributor base is inclined at an angle $\beta$=1° to 3° with respect to the conveyor-belt plane E.

Since the material of the part of the distributor base which extends to a location adjacent the front guide roller must have a finite thickness, the thickness at the casting-out or terminal edge of the distributor base is preferably D=1 to 5 mm.

To guide the solidified molten metal, laterally spaced boundary walls are integrated into the boundary walls of the metal distributor, wherein in particular the underside of the distributor base rests, in the area of these lateral boundaries, on the conveyor belt.

According to a, particular embodiment of the invention, the melt distributor is connectively arranged at the outlet of a furnace. In order to avoid an adjusting of the heavy holding furnace, it may, however, be advantageous in many cases to adjust the melt distributor independently of the holding furnace, namely to arrange same independently of the furnace.

In particular for the further moderation of the melt flow and to avoid slag inclusions in the surface of the strip, a smoothing bar movable in the conveyor-belt plane or perpendicularly thereto is associated with the melt distributor and according to the invention.

BRIEF DESCRIPTION OF THE DRAWINGS

The invention will be discussed in greater detail in connection with the following exemplary embodiments and the drawings, in which.

DETAILED DESCRIPTION

Figure 1:
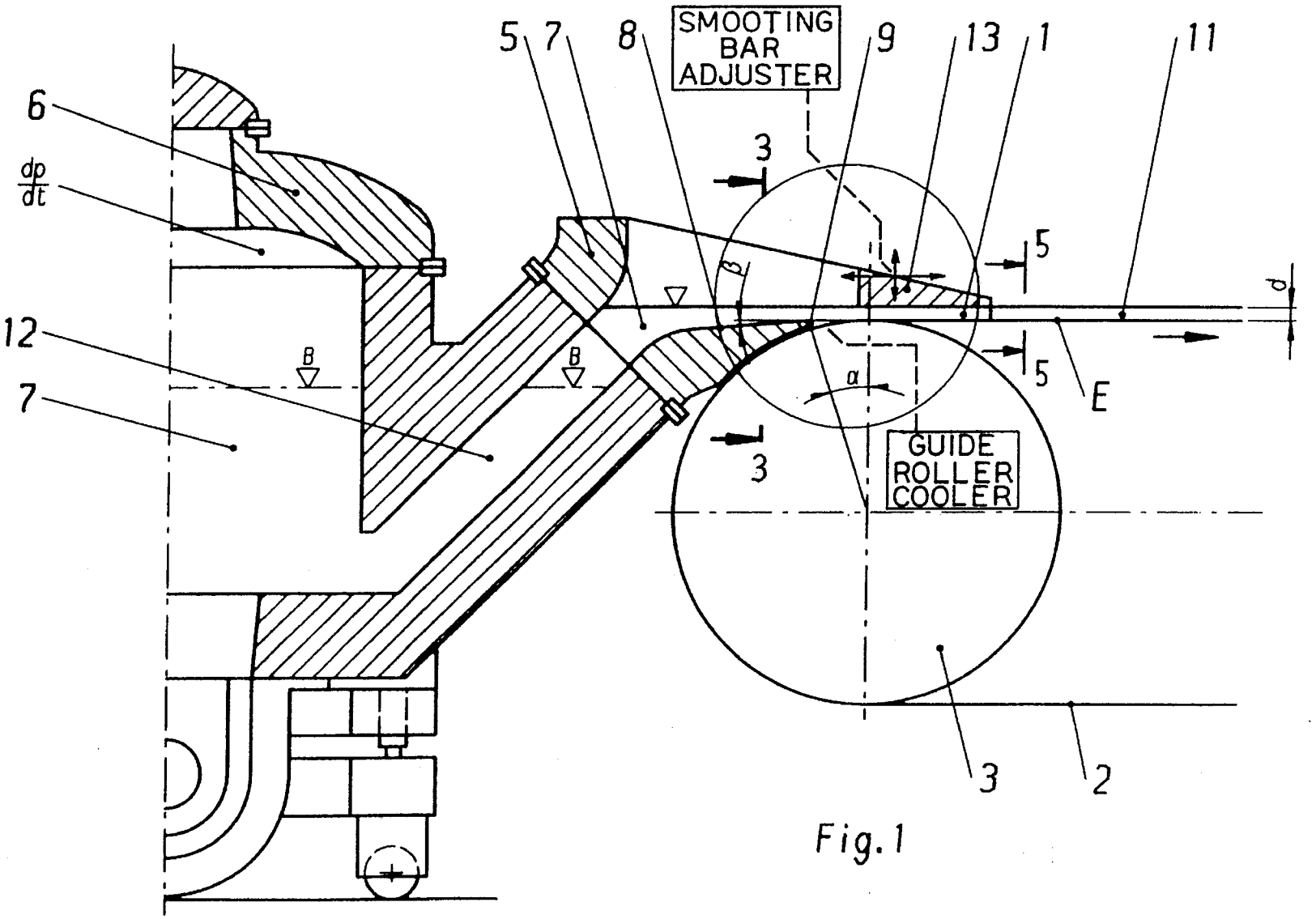
FIG. 1 shows one embodiment of a casting device with a melt distributor integrated with the outlet of a furnace and embodying the invention.

FIG. 1 shows a casting device for the continuous manufacture of a thin metal strip 1 consisting of a cooled conveyor belt 2 which is guided over guide rollers 3, 4 (reference numeral 4 is not shown), a melt distributor 5 and a holding furnace 6 for the molten metal 7. (The casting direction is indicated with an arrow.)

Figure 2:
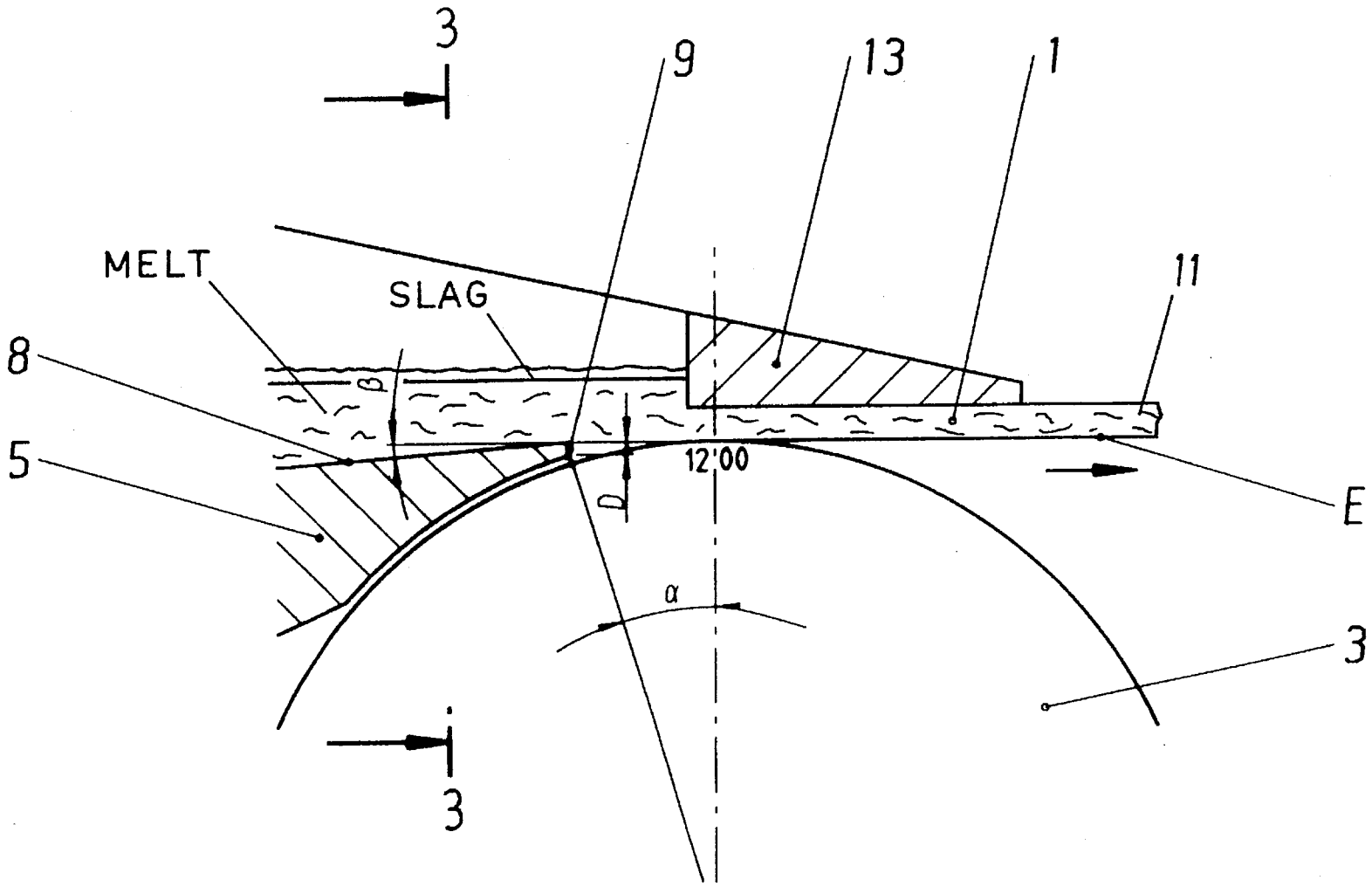
FIG. 2 shows an enlarged detail according to FIG. 1.

The melt distributor 5 is arranged with respect to the front guide roller 3 so that a distributor base 8 will be provided that will effect an essentially tangential feed of the melt 7 to a surface of the belt 2 on the guide roller 3 and at an angular center-point spacing $\alpha$ in front of the apex point (12:00 o'clock position) of the front guide roller 3 which is in,the range of 5° to 20°. The guide roller 3 is cooled intensively at least in the area thereof defined by the respective center-point angle $\alpha$ as schematically shown in FIG. 1. This can be accomplished, if desired, by a conventional water spraying device. Since the material of the terminal edge 9 of the distributor base 8 over which the melt passes must have a finite thickness D, the melt distributor 5 does not extend up to the 12:00 o'clock position of the front guide roller 3. In order to guarantee an even melt supply during the start-up phase, the distributor base 8 is slightly inclined at an angle $\beta$ with respect to the conveyor-belt plane E (compare detail according to FIG. 2).

Figure 3:
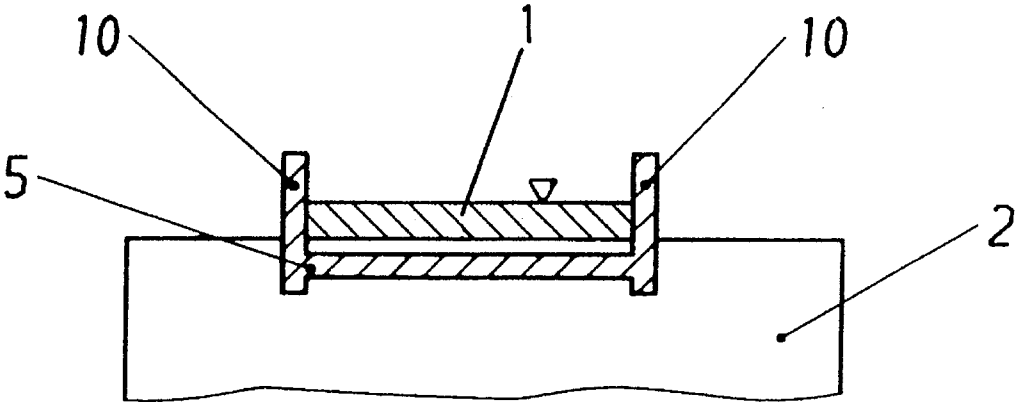
FIG. 3 is a cross-sectional view along the line 3—3 of FIG. 1.
Figure 5:
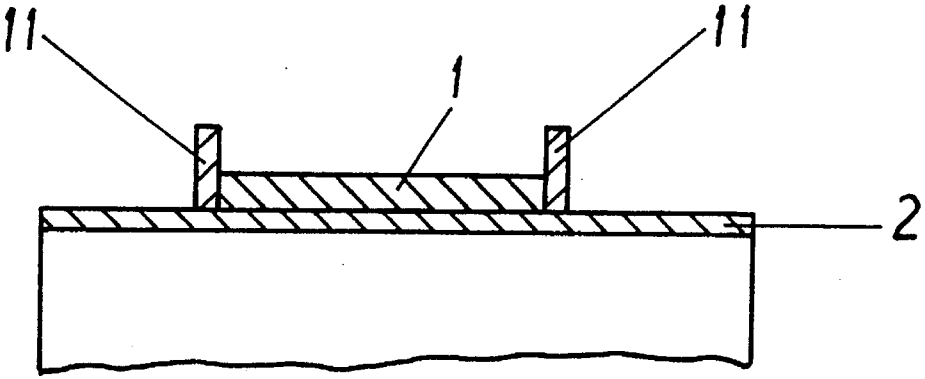
FIG. 5 is a cross-sectional view along the line 5—5 of FIG. 1.

FIG. 3 shows that lateral boundaries 10 are integrated into the melt distributor 5. The underside of the distributor base 8 rests only in the area of these boundaries 10 on the surface of the conveyor belt 2. The center part of the downwardly facing part of the melt distributor 5 is recessed at approximately 0.3 to 0.5 mm in order no prevent the coating material applied to the conveyor belt 2 from being wiped off. Moving on in the casting direction, lower height side dams 11 are mounted in a separate construction and are aligned end-to-end with the lateral boundaries 10 and, for sealing purposes, pressed with light pressure against the metal strip 1.

Advantageous is the combination of the melt distributor 5 with the pressure-loaded holding furnace 6 described in DE-PS 4 132 189. The molten metal 7 in the holding furnace 6 is, prior to the start-up phase, at the level B—B. It is slowly driven into the discharge pipette 12 by increasing the gas pressure in the holding furnace 6. The molten metal 7 thereby flows in the area of the distributor base 8 slowly and evenly distributed over the width, following the inclined angle β toward the feed point at the rotary guide roller 3. The edge 9 of the distributor base 8 is in the form of a small shoulder which, however, by no means results in a speeded up flow of the molten metal 7 during the start-up phase, primarily because the feed point of the melt to the belt 2 is still in front of the 12:00 o'clock position. This first molten metal 7 is cooled off and is carried off in the casting direction by the moving conveyor belt 2. The molten bath level is now further increased until it is at the desired strip thickness d above the conveyor-belt plane E. The free flowing off in the casting direction is prevented by the thickness of the hardening layer which is building up. To regulate the thickness of the strip it is possible to use the level control on the conveyor belt described in the DE-PS 4 132 189. This level control delivers suitable signals to the pressure control of the holding furnace 6. To avoid slag inclusions in the surface of the metal strip 1, a smoothing bar 13 having a variable position capability can be utilized. The bar 13 dips only 1 to 2 mm into the molten-bath level so that it holds the slag back at the free surface of the melt 7. In addition the bar 13 results in a moderation of the flow of the melt generally parallel to the belt plane E.

The free molten-bath level in the melt distributor 5 can be covered with a lid to protect against oxidation and can be protected by an inert gas (not illustrated).

Figure 4:
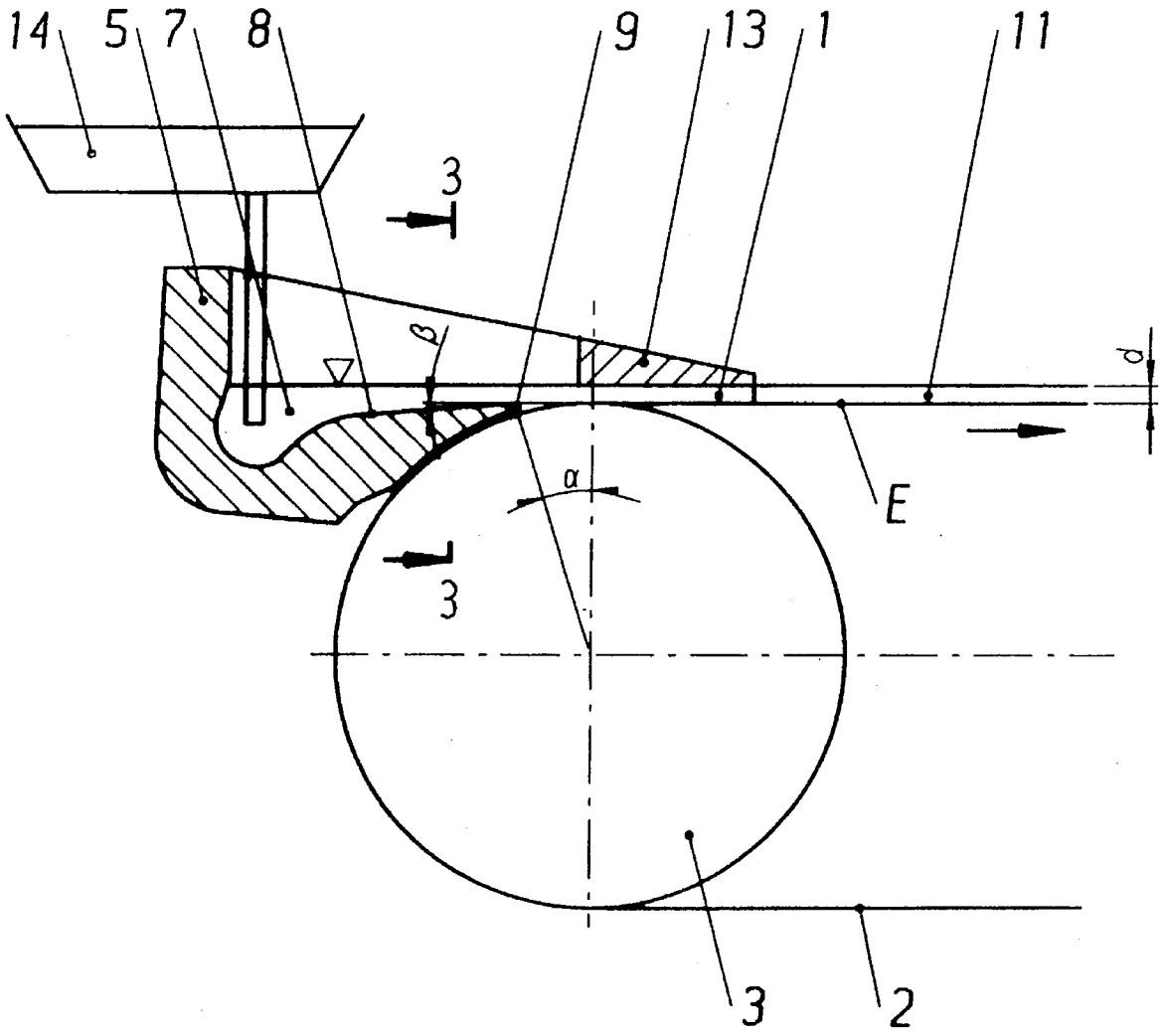
FIG. 4 shows a second embodiment of a casting device with a melt distributor independent of a furnace and embodying the invention.

FIG. 4 shows a modification of the casting device with a melt distributor 5 independent of the furnace embodying the invention. The molten metal 7 is here fed to the melt distributor 5 from a storage container 14.

Numerical example:

A strip 1 of CuFe having a dimension of 400 mm×8 mm was cast with the casting device of the invention at a casting speed of 10 m/min. The holding furnace 6 was for the start-up phase loaded with nitrogen at a constant pressure increase dp/dt. The pressure increase is thereby calculated from the strip cross section, the casting speed and the diameter of the holding furnace 6. With this, the start-up melt feed was adjusted approximately to the level needed to reach the desired strip cross section at a specified discharge speed. The melt level increased in the pipette 12 and was then evenly distributed in the distributor 5 following the slight incline of the distributor base 8. After reaching the distributor edge 9, the liquid metal flowed over the 5 mm thick edge 9 onto the conveyor belt 2 running over the front guide roller 3 and solidified immediately to a thin layer and was moved in the casting direction at the discharge speed. The flow of the melt 7 under the distributor base 8 was prevented by the principle of a dynamic seal. After adjusting the balance between the feeding and discharging stream of metal, the desired strip thickness was approximately adjusted, and the smoothing bar 13 was vetted by metal still liquidy at the surface. The metal accumulated approximately 4 mm higher in front of the smoothing bar 13 than at the lower edge of the smoothing bar 13. With this, slag was able to be reliably held back. An inert-gas cover was initially not used in order to make the observation of the casting operations easier. The inert-gas cover is necessary for longer casting cycles in order to minimize slag build-up.

Shortly after adjusting the balanced state between the feeding and the discharge stream of metal, a casting-level control (not shown) was added, which now took over the regulating of the furnace pressure dp/dt in dependency of the desired and actual thickness of the metal strip 1.

Thus a 40 m long strip 1 with narrow thickness tolerances was able to be cast.

The embodiments of the invention in which an exclusive property or privilege is claimed are defined as follows:

1. In a casting device for the continuous manufacture of a thin metal strip, comprising a moving, cooled conveyor belt which is guided by at least one rotating guide roller, said conveyor belt having a section that lies in a conveyor belt plane, and a melt distributor juxtaposed with said conveyor belt and said at least one rotating guide roller and from which molten metal is fed between first lateral boundaries thereof-onto said conveyor belt and is solidified, the improvement wherein said melt distributor has a distributor base lying in a plane and terminating in a terminal edge at a downstream end thereof, wherein said at least one guide roller includes a means for cooling at least an area of said conveyor belt defined by an angle α leading, as viewed in a moving direction of said conveyor belt, an apex point (12:00 o'clock position) of said at least one guide roller by an amount that is in the range of 5° to 20° wherein said plane of said distributor base immediately upstream of said terminal edge is oriented below said conveyor-belt plane and is further upwardly inclined in said moving direction at an angle β that is in a range of 1° to 3° to said conveyor-belt plane, and wherein means defining second laterally spaced boundaries are provided on and coextensively of said conveyor belt, said second laterally spaced boundaries being a continuation of said first laterally spaced boundaries on said melt distributor.

2. The casting device according to claim 1, wherein said range for said angle α is 5° to 10°.

3. The casting device according to claim 1, wherein said terminal edge has a thickness that is in a range of 1 to 5 mm.

4. The casting device according to claim 1, wherein an underside of said distributor base rests on said conveyor belt in an area adjacent said lateral boundaries of said conveyor belt.

5. The casting device according to claim 1, wherein said melt distributor is arranged contiguous with an outlet from a furnace.

6. The casting device according to claim 1, wherein said melt distributor is arranged independently of a furnace.

7. The casting device according to claim 1, wherein a smoothing bar is provided downstream of said melt distributor and above said conveyor-belt, said smoothing bar being adjustably movable both parallel to and perpendicular to said conveyor belt plane.

8. The casting device according to claim 1, wherein said terminal edge is located at the angle α from the apex point.

9. The casting device according to claim 8, wherein said terminal edge has a thickness that is in a range of 1 to 5 mm.

* * * * *